US009138779B2

(12) United States Patent
Anzai et al.

(10) Patent No.: US 9,138,779 B2
(45) Date of Patent: Sep. 22, 2015

(54) MULTILAYER COAT AND METHOD FOR PRODUCING THE SAME

(75) Inventors: Yasuhiro Anzai, Tochigi (JP); Hiroya Kanda, Tochigi (JP); Harumi Suetsugu, Tochigi (JP); Yasuhiro Kawai, Tochigi (JP)

(73) Assignee: DAI NIPPON TORYO CO., LTD., Osaka (JP)

( * ) Notice: Subject to any disclaimer, the term of this patent is extended or adjusted under 35 U.S.C. 154(b) by 0 days.

(21) Appl. No.: 14/005,319

(22) PCT Filed: Mar. 29, 2012

(86) PCT No.: PCT/JP2012/058403

§ 371 (c)(1),
(2), (4) Date: Sep. 16, 2013

(87) PCT Pub. No.: WO2012/133667

PCT Pub. Date: Oct. 4, 2012

(65) Prior Publication Data

US 2014/0004369 A1 Jan. 2, 2014

(30) Foreign Application Priority Data

Mar. 31, 2011 (JP) ..... 2011-080481

(51) Int. Cl.
*B05D 7/00* (2006.01)
*B05D 3/06* (2006.01)

(52) U.S. Cl.
CPC *B05D 7/56* (2013.01); *B05D 7/577* (2013.01); *B05D 3/067* (2013.01); *Y10T 428/31938* (2015.04)

(58) Field of Classification Search
CPC ..... B05D 3/067; B05D 7/56; B05D 7/577; Y10T 428/31938
USPC ..... 427/511
See application file for complete search history.

(56) References Cited

U.S. PATENT DOCUMENTS

| | | | | |
|---|---|---|---|---|
| 2003/0179269 | A1* | 9/2003 | Yamanouchi et al. | 347/101 |
| 2008/0184930 | A1* | 8/2008 | Furukawa | 118/46 |
| 2010/0233441 | A1 | 9/2010 | Kubota et al. | |

FOREIGN PATENT DOCUMENTS

| | | |
|---|---|---|
| JP | 07-31929 | 2/1995 |
| JP | 2007-044614 | 2/2007 |
| JP | 2007-152149 | 6/2007 |
| JP | 2008-149487 | 7/2008 |
| JP | 2010-106619 | 5/2010 |
| JP | 2010-167334 | 8/2010 |
| JP | 2010-234366 | 10/2010 |
| WO | 02100652 | 12/2002 |
| WO | 2008-044515 | 4/2008 |

OTHER PUBLICATIONS

International Search Report PCT/JP2012/058403 dated Jul. 3, 2012, with English Translation.

* cited by examiner

*Primary Examiner* — Dah-Wei D Yuan
*Assistant Examiner* — Kristen A Dagenais
(74) *Attorney, Agent, or Firm* — Young & Thompson

(57) ABSTRACT

Disclosed is a method for producing a multilayer coat characterized by including the steps of coating a substrate with an undercoating material to form an undercoat layer, coating the undercoat layer with an active energy ray-curing type ink in an ink-jet system, curing the active energy ray-curing type ink through active energy ray irradiation, and coating the cured active energy ray-curing type ink with a top coating material to form a top coat layer, wherein the surface free energy of the undercoat layer is $\gamma_s$=20-50 mN/m, the active energy ray-curing type ink has a surface tension at 40° C. of 20-35 mN/m, and the top coating material has a surface tension at 25° C. of 20-50 mN/m, as well as a multilayer coat obtained by the production method.

12 Claims, No Drawings

MULTILAYER COAT AND METHOD FOR PRODUCING THE SAME

TECHNICAL FIELD

This invention relates to a multilayer coat and a method for producing the multilayer coat. More particularly, it relates to a multilayer coat having excellent adhesive properties, water resistance and weathering resistance, and a method for producing the multilayer coat.

BACKGROUND ART

In decorative laminates used as materials for interior and exterior of buildings, there are various kinds of those such as, beginning with inorganic decorative laminates, metal siding, vinyl chloride-extruded siding, foamed lightweight concrete panels, metallic plates, tiles and so on. The surface of these decorative laminates is usually subjected to various patterning for the purpose of keeping a substrate from deteriorating, or improving the designability of appearance.

Recently, higher designability is increasingly demanded with regard to the patterning of these decorative laminates for interior and exterior of buildings. There is proposed a method of forming a high-definition image with an ink-jet technique (Patent Document 1).

The decorative laminates patterned in such a printing system, in particular, those for outdoor use, are demanded to have higher water resistance and weathering resistance of ink. Thus, pigments are used as a colorant for ink instead of dyes. An ink using a pigment as a colorant, in particular, a water-based ink is usually insufficient in printing density and the dispersion stability of pigments. When an ink-jet printer is used as a means of printing, there is a problem in production that the clogging of a nozzle tends to be caused in its head.

In this kind of decorative laminates for buildings, the intended purpose of coating the surface of its substrate is to shield the substrate's surface from a deteriorating factor like water or oxygen to keep the substrate from deteriorating. Thus, a prime coat is formed on the surface of the substrate before patterning in order to accomplish this purpose. The surface condition of such a prime coat thickens out of the need, and hence ink droplets discharged on the prime coat disposed on the surface of the substrate are spread on the surface of the prime coat without absorbing them into the prime coat. Thus, it is difficult to draw a precise image. For this reason, it is necessary to preliminarily form a receiving layer prior to ink-jet coating in order to improve the ink absorbability of the prime coat. There is proposed that an inorganic filler, such as silica fine particles, having high oil absorption is compounded into a prime coating material (Patent Document 2).

For the purpose of performing high definition patterning in a printing system, the surface of a substrate is coated with a coating material for the formation of a surface to be printed which comprises hydrophilic cross-linked resin particles, to form an ink receiving layer having excellent ink absorbability. Moreover, a water-based ink which substantially comprises no binder such as a resin or the like is used as ink, which becomes difficult for the clogging of a nozzle to be caused even if the nozzle bore diameter of the head of an ink-jet printer is made smaller, but also ink running can be sufficiently prevented. Thereby, there is proposed a method of producing a building material having designability which is capable of easily printing a high definition pattern (Patent Document 3). There is also proposed a method of producing a building material having designability which is intended to improve ink durability and prevent ink running, by coating the surface of a substrate with a coating material for the formation of a surface to be printed to form an ink receiving layer in the same manner, and then preliminarily-discharging a coloring ink containing a reactive compound A on the receiving layer to form an image and thereafter discharging a clear ink containing a reactive compound B, which generates curing reaction with the reactive compound A, into this ink image or, on the contrary, preliminarily-discharging a clear ink containing a reactive compound B to form a clear region and thereafter discharging a coloring ink containing a reactive compound A (Patent Document 4).

In these decorative laminates for buildings, various coating materials or patterning inks used in their production process are intended to reduce environmental pollution or improve working environment, as is the case for other coating or printing industry. In particular, the decorative laminates for outdoor use is refraining from the use of a solvent-based coating material or ink which discharges a large amount of a volatile organic compound (VOC) for the purpose of preventing sick house syndrome from being developed, and the substitution of a water-based coating material or ink is proceeding.

In the above-mentioned conventional decorative laminates for buildings, when a water-based coating material is used as a coating material for forming a prime coat (ink receiving layer) and/or a water-based ink is used as an ink for forming the colored pattern or design (printing layer), the ink receiving layer or printing layer is inferior in water resistance because they are formed by a coating material or ink using an aqueous solvent. Even if a pigment having excellent water resistance and weathering resistance is used as a coloring material for a water-based ink, for example, when it is weathered outdoors, the ink receiving layer or printing layer is easily deteriorated and the desired pattern formed on the printing layer is broken down. Thus, for the purpose of protecting the ink receiving layer or printing layer formed on the surface of the decorative laminates for buildings, there is carried out coating the printing layer with a clear coating material to form a top coat layer made from the clear coating material having excellent coat durability such as water resistance, weathering resistance and so on.

However, in the case of forming a top coat layer with a water-based clear coating material, the ink forming design in the printing layer is redissolved in an aqueous solvent of the water-based clear coating material applied thereon and hence ink running occurs in the printing layer. In some cases, peeling occurs between an ink receiving layer and a top clear layer, so that sufficient protection performance cannot be necessarily obtained in the water resistance and ink running of the printing layer. Thus, there is a need to use a solvent-based clear coating material as a clear coating material for forming a top coat layer from the viewpoint of the quality stability of products.

There is further proposed a technique of using an active energy ray-curing type ink-jet ink as an ink-jet ink for providing a high definition pattern (Patent Document 5). The active energy ray-curing type ink is excellent in quick-drying properties because it is cured immediately through active energy ray irradiation, it does not need a receiving layer because the ink membrane contains a resin component, and the curing proceeds only through active energy ray irradiation unlike in the case of a resin-containing ink-jet ink. In these reasons, the clogging of a head portion due to the solidification of a resin does not occur and hence discharge stability is excellent. Further, an amount of emission of VOC is very small because almost total amount of the applied ink is fixed as a coat on a substrate, and hence there is an advantage of being able to reduce environmental loads.

However, the coat formed by the active energy ray-curing type ink is low in the adhesion to a substrate and/or in the adhesion between an ink layer and a top coating layer when further forming the top coating layer on the coat of the active energy ray-curing type ink. Thus, delamination tends to take place and thereby there is a problem of reducing weathering resistance.

CITED DOCUMENTS LIST

Patent Document

Patent Document 1: Japanese Patent Application Publication No. H07-31929

Patent Document 2: International Publication No. WO 2002/100652

Patent Document 3: Japanese Patent Application Publication No. 2007-44614

Patent Document 4: Japanese Patent Application Publication No. 2007-152149

Patent Document 5: Japanese Patent Application Publication No. 2010-167334

SUMMARY OF THE INVENTION

Problems to be Solved by the Invention

It is an object of the invention to solve the above-mentioned problems, and to provide a multilayer coat for obtaining a decorative laminate for interior and exterior of buildings comprising a pattern with high designability on its surface and having excellent adhesive properties, water resistance and weathering resistance, as well as a method for producing the multilayer coat.

Means of Solving the Problems

We have made various studies in order to solve the problems and found out that the specified ranges of the surface free energy of an undercoat layer, the surface tension of an active energy ray-curing type ink and the surface free energy of a top coating material can result in a multilayer coat comprising a pattern with high designability and having excellent adhesive properties, water resistance and weathering resistance without delamination, and as a result the invention has been accomplished.

According to the invention, there is provided a method for producing a multilayer coat characterized by comprising the following steps of:

coating a substrate with an undercoating material to form an undercoat layer;

coating the undercoat layer with an active energy ray-curing type ink in an ink-jet system;

curing the active energy ray-curing type ink through active energy ray irradiation; and coating the cured active energy ray-curing type ink with a top coating material to form a top coat layer;

wherein a surface free energy of the undercoat layer is $\gamma_s$=20-50 mN/m, the active energy ray-curing type ink has a surface tension at 40° C. of 20-35 mN/m, and the top coating material has a surface tension at 25° C. of 20-50 mN/m.

According to the invention, there is also provided a multilayer coat characterized by obtaining with the above-described method for producing a multilayer coat.

Effects of the Invention

In the multilayer coat and the method for producing the multilayer coat according to the invention, the specified ranges of the surface free energy of the undercoat layer, the surface tension of the active energy ray-curing type ink and the surface free energy of the top coating material can result in a multilayer coat comprising a pattern with high designability and having excellent adhesive properties, water resistance and weathering resistance without delamination.

MODE FOR CARRYING OUT THE INVENTION

The embodiments of the invention will be described in detail below, but the invention is not limited thereto.

<Method for Producing a Multilayer Coat>

The method for producing a multilayer coat according to the invention is characterized by comprising the following steps of:

coating a substrate with an undercoating material to form an undercoat layer;

coating the undercoat layer with an active energy ray-curing type ink in an ink-jet system;

curing the active energy ray-curing type ink through active energy ray irradiation; and coating the cured active energy ray-curing type ink with a top coating material to form a top coat layer;

wherein the surface free energy of the undercoat layer is $\gamma_s$=20-50 mN/m, the surface tension of the active energy ray-curing type ink is 20-35 mN/m at 40° C., and the surface tension of the top coating material is 20-50 mN/m at 25° C. According to the invention, the surface free energy of the undercoat layer, the surface tension of the active energy ray-curing type ink and the surface free energy of the top coating material are in the above specified ranges, so that the multilayer coat with excellent adhesive properties, water resistance and weathering resistance can be formed.

<Substrate>

In carrying out the invention, the substrate which the multilayer coat according to the invention is formed on is not particularly limited and the substrate commonly-used as interior and exterior materials for buildings can be used.

The material of the substrate which the multilayer coat according to the invention is formed on includes, for example, inorganic materials such as a flexible board, a calcium silicate board, a gypsum slag perlite board, a calcium carbonate board, a wood chip cement board, a precast concrete board, an autoclaved lightweight concrete (ALC) board, a gypsum board, glass and the like, various plastic materials such as polyethylene, polypropylene, polyvinyl chloride, polyvinylidene chloride, ABS resin, melamine resin, acrylic resin, polyester (polyethylene terephthalate, etc.) resin, polyurethane resin and the like, and metals, including alloys, such as aluminum, iron, stainless and the like, and so on. These materials may be used in a combination of two or more. The surface of the substrate may be preliminarily subjected to various surface treatment, or sealer and/or primer coating, etc. The shape of the substrate may be smooth or have concavity and convexity.

<Undercoat Layer>

Various enamel coating materials can be used as a coating material for forming an undercoat layer in the invention. The enamel coating materials include a solvent-based coating material using an organic solvent as a main solvent, a water-based coating material using water as a main solvent, a non-solvent-based coating material, a powder coating material, or the like. The water-based coating material, non-solvent-based coating material and powder coating material are preferable in light of environmental consciousness, because these materials can further reduce the emission of a volatile organic compound (VOC). The water-based coating material is more preferable than the non-solvent-based coating material and powder coating material, because the water-based coating material is easy to handle due to one-part type, while the non-solvent-based coating material is difficult to handle and the powder coating material is required to be dried and baked at a high temperature, possibly not less than 200° C. The undercoating material can include various coloring and/or extender pigments.

The surface free energy of the undercoat layer of the invention is required to be $\gamma_s$=20-50 mN/m. In the case where the surface free energy $\gamma_s$ of the undercoat is smaller than 20 mN/m, when an active energy ray-curing type ink is printed on the undercoat layer in an ink-jet system, the active energy ray-curing type ink becomes difficult to be sufficiently spread in a wet condition, so that a clear image cannot be obtained, but also the adhesion to the ink layer is deteriorated, which causes delamination between the undercoat layer and the ink layer. In the case where the surface free energy $\gamma_s$ of the undercoat is larger than 50 mN/m, when an active energy ray-curing type ink is printed on the undercoat layer in an ink-jet system, the active energy ray-curing type ink is wet-spread in large excess and hence the sharpness of an image is deteriorated. The method of conditioning the surface free energy of the undercoat layer of the invention within the above-mentioned specified range includes, for example, a method of using various surface conditioners, and so on.

The surface free energy of the undercoat layer of the invention is calculated according to Owens equation obtained by expanding Fowkes equation, and Young equation, and it can be calculated by determining an angle of contact between two substances of which the surface free energies are known and each coat surface and using the following equations:

$$\gamma_L(1+\cos\theta_L)=2(\gamma_s^d\times\gamma_L^d)^{1/2}+2(\gamma_s^p\times\gamma_L^p)^{1/2}$$

$$\gamma_s=\gamma_s^d+\gamma_s^p$$

in which, $\gamma_s$ is the surface free energy of a substance, $\gamma_s^p$ is the polarity component of the surface free energy and $\gamma_s^d$ is the dispersion component of the surface free energy.

The method of forming the undercoat layer of the invention includes methods using various conventionally-used coating means such as an air spray, an airless spray, a roll coater, a flow coater and the like. If needed, a substrate is heated before or after undercoating, so that drying and/or curing can be accelerated.

The coating amount of the undercoating material is preferably 20-200 g/m$^2$. When it is less than 20 g/m$^2$, hiding properties are inferior. While, when it exceeds 200 g/m$^2$, drying and/or curing tend to become worse and hence coat performance is deteriorated.

Various synthetic resins can be used as the resin used in the coating material for forming an undercoat. The synthetic resins include acrylic resins, alkyd resins, polyester resins, polyurethane resins, epoxy resins, silicone resins, fluorine resins and the like. These resins may be used in a combination of two or more. The coating material for forming an undercoat may be properly added with coloring and/or extender pigments, a thickening agent, a dispersant, an antifoamer, an anti-settling agent, a mildewproofing agent, a preservative, an ultraviolet light absorber, a light stabilizer or the like in order to impart various functions.

<Active Energy Ray-Curing Type Ink>

Those that are cured through the irradiation of various active energy rays, such as ultraviolet light (UV), electron beam (EB) or the like, can be used as the active energy ray-curing type ink of the invention. The UV-curing type ink is preferable from the view point of costs and equipment investment.

In the curing reaction of the active energy ray-curing type ink, various reaction mechanisms such as anionic polymerization, cationic polymerization, radical polymerization or the like can be used. These two or more mechanisms may be combined for the improvement of curing properties.

The active energy ray-curing type ink is preferable to comprise 50-90% by mass of at least one monomer having an ethylenic unsaturated group and 0.5-15% by mass of at least one inorganic pigment as a colorant.

Various pigments consisting of commercially-available organic and/or inorganic compounds can be used as the colorant used in the active energy ray-curing type ink. The inorganic pigment is preferable to be excellent in weathering resistance. When the content of the colorant is less than 0.5% by mass, sufficient hiding properties cannot be achieved and hence coating with a large amount of an ink has to be done, so that the productivity can be inferior but also ink running and insufficient curing can be caused. While, when the content of the colorant exceeds 15% by mass, the viscosity becomes higher and hence the discharge stability is deteriorated or the pigment shields active energy rays, which causes insufficient curing. Concerning the particle diameter of the colorant of the active energy ray-curing type ink, it is preferable that the mean particle diameter is 40-500 nm and the cumulative maximum particle diameter is not more than 1 μm, as measured according to dynamic light scattering method. When the cumulative maximum particle diameter exceeds 1 μm, clogging tends to be caused in a nozzle portion for use in an ink-jet system.

The coating of the undercoat layer with the active energy ray-curing type ink in an ink-jet system is performed for forming a pattern with high designability on the substrate. The typical ink-jet system includes, for example, a method of discharging an ink in an on-demand system or a charge control system. In particular, when an ink-jet system is used, coating with an ink can be performed only at an intended portion, so that a pattern with high designability can be formed.

In the case of coating with the active energy ray-curing type ink in an ink-jet system, since the ink viscosity is generally adjusted to the optimum range, the ink is heated up to 35-50° C. in an ink-jet head portion and then is discharged. In order to perform better coating, the surface tension of the active energy ray-curing type ink used for the invention is required to be 20-35 mN/m at 40° C. When the surface tension is less than 20 mN/m, the ink is wet-spread in large excess on the undercoat layer and hence the sharpness of an image is deteriorated. In addition, it is wet-spread in large excess on the nozzle tip portion of a head portion and hence the discharge stability is deteriorated. While, when the surface tension of the ink exceeds 35 mN/m, the ink is not sufficiently wet-spread on the undercoat layer and hence coating with a large amount of the ink has to be done for achieving deep hue, so that the productivity can be deteriorated. The viscosity of the active energy ray-curing type ink is preferable to be 5-15 mPa·s at 40° C. for stable discharging. The method of adjusting the surface tension at 40° C. of the active energy ray-curing type ink of the invention to the above-specified range includes, for example, a method of using various surface conditioners, and so on.

The monomer having an ethylenic unsaturated group used in the active energy ray-curing type ink of the invention includes as a monomer having one ethylenic unsaturated group in its molecule, for example, various (meth)acrylate monomers and N-vinyl monomers such as stearyl(meth)acrylate, acryloyl morpholine, tridecyl(meth)acrylate, lauryl (meth)acrylate, N,N-dimethylacrylamide, decyl(meth)acrylate, isodecyl(meth)acrylate, isobornyl(meth)acrylate, dicyclopentenyl(meth)acrylate, dicyclopentenyl(meth)acrylate, isooctyl(meth)acrylate, octyl(meth)acrylate, dicyclopentenyloxyethyl(meth)acrylate, cyclohexyl(meth)acrylate, N-vinyl caprolactam, isoamyl(meth)acrylate, 2-ethylhexyl-diglycol(meth)acrylate, ethylene oxide-modified 2-ethylhexyl(meth)acrylate, neopentyl glycol(meth)acrylic acid benzoate, N-vinyl-2-pyrolidone, N-vinylimidazole, tetrahydrofurfuryl(meth)acrylate, methoxy dipropylene glycol (meth)acrylate, (2-methyl-2-ethyl-1,3-dioxolan-4-yl)methyl (meth)acrylate, cyclic trimethylolpropane formal(meth) acrylate, ethyl carbitol(meth)acrylate, 2-(2'-vinyloxyethoxy) ethyl(meth)acrylate, and the like. These two or more monomers may be combined. Alicyclic monomers such as isobornyl(meth)acrylate, cyclohexyl(meth)acrylate and the like are preferable in light of the change in color of a coat after curing, while phenoxyethyl(meth)acrylate and ethyl carbitol (meth)acrylate are preferable in light of the flexibility of a coat, and hence it is preferable to design an ink by combining them.

In the active energy ray-curing type ink of the invention, a monomer having two or more ethylenic unsaturated groups in its molecule can be used as the monomer having an ethylenic unsaturated group for improving the toughness of a cured coat and/or accelerating cure. These monomers having two or more ethylenic unsaturated groups include, for example, various (meth)acrylate monomers such as hydroxypivalic acid neopentyl glycol di(meth)acrylate, polytetramethylene glycol di(meth)acrylate, trimethylolpropane(meth)acrylic acid benzoate, diethylene glycol di(meth)acrylate, triethylene glycol di(meth)acrylate, tetraethylene glycol di(meth)acrylate, polyethylene glycol (200, 400 or 600) di(meth)acrylate, neopentyl glycol di(meth)acrylate, 1,3-butylene glycol di(meth) acrylate, 1,4-butanediol di(meth)acrylate, 1,5-pentanediol di(meth)acrylate, 1,6-hexanediol di(meth)acrylate, 1,8-octanediol di(meth)acrylate, 1,9-nonanediol di(meth)acrylate, 1,10-decanediol di(meth)acrylate, dimethylol-tricyclodecane di(meth)acrylate, bisphenol A di(meth)acrylate, pentaerythritol tri(meth)acrylate, trimethylolpropane tri(meth) acrylate, glycerin tri(meth)acrylate, pentaerythritol tetra (meth)acrylate, trimethylolpropane tetra(meth)acrylate and the like, as well as alkylene glycol-modified forms of these monomers. These two or more monomers may be combined. Neopentyl glycol di(meth)acrylate, 1,4-butanediol di(meth) acrylate, 1,6-hexanediol di(meth)acrylate and 1,9-nonanediol di(meth)acrylate are preferable in light of the toughness of a cured coat, curing properties, the change in color of a coat after curing.

In the active energy ray-curing type ink, modified acrylate monomers and/or oligomers, such as urethane-modified (meth)acrylate, epoxy-modified (meth)acrylate, silicone-modified (meth)acrylate, polyester-modified (meth)acrylate and the like, can be used as the monomer having an ethylenic unsaturated group for improving the toughness or flexibility of a cured coat, the adhesion to an undercoat layer and/or a top coat layer, and/or for suppressing a decrease in volume during curing (this is called cure shrinkage).

Various commercially available products, including, for example,

Beamset 502H, Beamset 505A-6, Beamset 550B, Beamset 575, Beamset AQ-17 (made by Arakawa Chemical Industries, Ltd.);

UA-306H, UA-306I, UA-510H, UF-8001G (made by Kyoeisha Chemical Co., Ltd.);

CN929, CN940, CN944B85, CN959, CN961E75, CN961H81, CN962, CN963A80, CN963B80, CN963E75, CN963E80, CN963J75, CN964, CN964A85, CN964E75, CN965, CN965A80, CN966A80, CN966B85, CN966H90, CN966J75, CN966R60, CN968, CN980, CN981, CN981A75, CN981B88, CN982A75, CN982B88, CN982E75, CN982P90, CN983, CN985B88, CN989, CN991, CN996, CN9001, CN9002, CN9004, CN9005, CN9006, CN9007, CN9008, CN9009, CN9010, CN9011, CN9014, CN9178, CN9788, CN9893 (made by Sartomer Company);

U-4HA, U-6HA, U-6LPA, UA-1100H, UA-53H, UA-33H, U-200PA, UA-4200, UA-122P (made by Shin-Nakamura Chemical Co., Ltd.);

New Frontier R-1214, New Frontier R-1301, New Frontier R-1304, New Frontier R-1306X, New Frontier R-1150D (made by Dai-ichi Kogyo Seiyaku Co., Ltd.);

EBECRYL 230, EBECRYL 244, EBECRYL 245, EBECRYL264, EBECRYL 265, EBECRYL 270, EBECRYL 284, EBECRYL 285, EBECRYL 294, EBECRYL 1290, EBECRYL 4820, EBECRYL 5129, EBECRYL 8201, EBECRYL 8402 (made by Daicel-Cytec Company Ltd.);

UV-1700B, UV-7600B, UV-7605B, UV-6630B, UV-7000B, UV-7461TE, UV-3000B, UV-3310B, UV-3520TL, UV-3700B (made by Nippon Synthetic Chemical Co., Ltd.);

Art Resin UN-333, UN-1255, UN-2600, UN-2700, UN-5500, UN-5507, UN-6060P, UN-6200, UN-6300, UN-6301, UN-7600, UN-7700, UN-9000PEP, UN-9200A, UN-3320HA, UN-3320HC, UN-904 (made by Negami Chemical Industrial Co., Ltd.);

Aronix M-6100, Aronix M-6200, Aronix M-6250, Aronix M-6500, Aronix M-7100, Aronix M-7300K, Aronix M-8030, Aronix M-8060, Aronix M-8530, Aronix M-8560, Aronix M-9050 (made by Toagosei Co., Ltd.), and so on, can be used as the modified acrylate monomers and/or oligomers. Various synthetic products obtained by a known technique, such as polyaddition reaction of a polyol with an isocyanate, can be used as the modified acrylate monomers and/or oligomers. They may be used in a combination of two or more.

The active energy ray-curing type ink can be added with high molecular weight substances having a molecular weight of not less than 5000 and no ethylenic unsaturated group for improving the toughness or flexibility of a cured coat, and/or for suppressing cure shrinkage. These high molecular substances have high toughness or flexibility in themselves but do not cause the ethylenic unsaturated group-derived polymerization reaction with the above-mentioned monomers having an ethylenic unsaturated group, so that they make it possible to impart toughness or flexibility to a coat and reduce cure shrinkage. By selecting a high molecular substance having a functional group such as a carboxyl group, an epoxy group, a hydroxyl group and the like, adhesive properties can be improved between an undercoating material and a top coating material.

Various commercially available products, including, for example,

Dianal BR-50, Dianal BR-52, Dianal BR-60, Dianal BR-64, Dianal BR-73, Dianal BR-75, Dianal BR-77, Dianal BR-80, Dianal BR-82, Dianal BR-83, Dianal BR-84, Dianal BR-85, Dianal BR-87, Dianal BR-88, Dianal BR-90, Dianal BR-95, Dianal BR-96, Dianal BR-100, Dianal BR-101, Dianal BR-102, Dianal BR-105, Dianal BR-106, Dianal BR-107, Dianal BR-108, Dianal BR-110, Dianal BR-1122, Dianal BR-113, Dianal BR-115, Dianal BR-116, Dianal BR-117, Dianal BR-118, Dianal BR-122, Dianal BR-605, Dianal MB-2539, Dianal MB-2389, Dianal BR-2660, Dianal BR-2952, Dianal MB-3012, Dianal BR-3015, Dianal MB-7033, Dianal MB-2478 (made by Mitsubishi Rayon Co., Ltd.);

CAB-551-0.01, CAB-551-0.2, CAB-553-0.4, CAB-531-1, CAB-500-5, CAB-381-0.1, CAB-381-0.5, CAB-381-2, CAB-321-0.1, CAB-504-0.2, CAB-482-0.5, Solus 2100, Solus 2300, Solus 3050 (made by Eastman Chemical Company);

Paraloid A-11, Paraloid A-14, Paraloid A-21, Paraloid B-60, Paraloid B-64, Paraloid B-66, Paraloid B-72, Paraloid B-82, Paraloid B-44, Paraloid B-48N, Paraloid B-67, Paraloid RG-310 (made by Roam And Haas Company), and so on, can be used as the high molecular substance having no ethylenic unsaturated group. Various high molecular substances obtained by a known technique can be synthesized and used. These substances may be used in a combination of two or more.

When the active energy ray-curing type ink is cured through ultraviolet light irradiation, photo-polymerization initiators can be used. The photo-polymerization initiators include radical polymerization-based initiators, for example, 2,2-dimethoxy-1,2-diphenylethan-1-one, 1-hydroxy-cyclohexyl-phenyl-ketone, 2-hydroxy-2-methyl-1-phenylpropan-1-one, benzophenone, 1-[4-(2-hydroxyethoxy)-phenyl]-2-hydroxy-2-methyl-1-propan-1-one, 2-hydroxy-1-{4-[4-(2-hydroxy-2-methylpropionyl)-benzyl] phenyl}-2-methyl-propan-1-one, phenylglyoxylic acid methyl ester, 2-methyl-1-[4-(methylthio)phenyl]-2-morpholino propan-1-one, 2-benzyl-2-dimethylamino-1-(4-morpholinophenyl)-butanone, 2-dimethylamino-2-(4-methyl-benzyl)-1-(4-morpholin-4-yl-phenyl)-butan-1-one, bis(2,4,6-trimethylbenzoyl)-phenylphosphine oxide, bis(2,6-dimethoxybenzoyl)-2,4,4-trimethyl-pentylphosphine oxide, 2,4,6-trimethybenzoyl-diphenyl-phosphine oxide, 1,2-octanedione, 1-[4-(phenylthio)-2-(O-benzoyloxime)], ethanone, 1-[9-ethyl-6-(2-methylbenzoyl)-9H-carbazol-3-yl]-, 1-(O-acetyloxime), 2,4-diethyl thioxanthone, 2-isopropyl thioxanthone, 2-chloro thioxanthone, and so on. These two or more initiators may be combined. 2,4,6-trimethylbenzoyl-diphenylphosphine oxide is more preferable, because the appearance of the molecule is discolored after degradation due to active energy ray irradiation and hence the coloring to a cured coat can be reduced. If needed, various sensitizers such as trimethylamine, methyl dimethanolamine, triethanolamine, p-dimethylaminoacetophenone, ethyl p-dimethylaminobenzoate, isoamyl p-dimethylaminobenzoate, N,N-dimethyl benzylamine, 4,4'-bis(diethylamino)benzophenone, 2,4-diethyl thioxanthone, 2-isopropyl thioxanthone and the like, as well as polymerization accelerators can be used.

In the active energy ray-curing type ink, various surface conditioners can be used for improving the adhesion to an undercoating material and/or for improving the wetting properties to an undercoating material.

In the active energy ray-curing type ink, light stabilizers such as an ultraviolet light absorber, a radical scavenger or the like can be used for improving the weathering resistance of a coat. Various polymerization inhibitors such as hydroquinone-based compounds and the like can also be used for improving storage stability.

Various light sources, such as a high-pressure mercury lamp, a metal halide lamp, a LED lamp and the like, can be used as a light source for curing the active energy ray-curing type ink. The dominant wavelength thereof is preferable to be 300-450 nm. The output of the light source for curing the active energy ray-curing type ink is preferable to be in the range of 50-300 W/cm. When the output of the light source is less than 50 W/cm, the irradiation intensity of active energy rays is weak, the active energy ray-curing type ink causes a poor cure and hence coat performance such as adhesive properties, weathering resistance or the like is deteriorated. While, when the irradiation intensity of the light source exceeds 300 W/cm, the heat emitted by the light source leads to the deterioration of the undercoat layer and/or the image layer formed by the active energy ray-curing type ink, whereby coat performance is deteriorated, such as gloss reduction, crack generation, and coat discoloration, etc.

The amount of irradiation of active energy rays is preferable to be an integrated amount of light of 50-500 mJ/cm$^2$. When the integrated light amount of active energy rays is less than 50 mJ/cm$^2$, the membrane of the active energy ray-curing type ink tends to occur a poor cure and hence coat performance such as adhesive properties, weathering resistance or the like is deteriorated. While, when the integrated light amount of active energy rays exceeds 500 mJ/cm$^2$, the active energy rays lead to the deterioration of the undercoat layer and/or the image layer formed by the active energy ray-curing type ink, which causes the deterioration of coat appearance such as gloss reduction, crack generation, coat discoloration and the like, or the reduction in coat performance such as weathering resistance and the like.

<Top Coat Layer>

Various clear coating materials, such as a solvent-based coating material, a water-based coating material, a non-solvent-based coating material, a powder coating material or the like, can be used as the top coating material of the invention. The water-based coating material, non-solvent-based coating material and powder coating material are preferable in light of environmental consciousness, because these materials can further reduce the emission of VOCs. The active energy ray-curing type clear coating material which has quick-drying properties and excellent productivity can be used in the field which does not require high weathering resistance, such as the field of interior materials and the like. The water-based coating material is more preferable than the non-solvent-based coating material and powder coating material, because the water-based coating material is easy to handle due to one-part type, while the non-solvent-based coating material is difficult to handle and the powder coating material is required to be dried and baked at a high temperature, possibly not less than 200° C. Among them, an aqueous clear coating material is preferable. The clear coating material of the invention refers to a transparent coating material, which means the coating material which does not hide a lower coat layer due to coloring.

Various synthetic resins, such as acrylic resins, alkyd resins, polyester resins, polyurethane resins, epoxy resins, silicone resins, fluorine resins and the like, can be used as the resin used in the coating material for forming an top coat. These resins may be used in a combination of two or more.

In the top coating material, light stabilizers such as an ultraviolet light absorber can be used for the purpose of improving weathering resistance. These light stabilizers may be used in a combination of two or more. The top coating material can be added with various extender pigments or resin beads, or the like in order to condition the finished appearance of gloss and design, etc. They may be used in a combination of two or more. The top coating material can be added with an adhesion improvement agent such as a silane coupling agent for improving the adhesion to an undercoating material. The top coating material may be properly added with a thickening agent, a dispersant, an antifoamer, an anti-settling agent, a mildewproofing agent, a preservative, or the like in order to impart various functions.

The surface tension of the top coating material of the invention is required to be 20-50 mN/m at 25° C. When the surface tension is less than 20 mN/m, bubbles tend to be generated and hence the addition of a large amount of an antifoamer is required. For this reason, coat defect such as cissing is caused in the case of the coating with the top coat material of the ink layer which is formed by printing the active energy ray-curing type ink in an ink-jet. While, when the surface tension exceeds 50 mN/m, it makes it difficult to sufficiently wet-spread it on the ink layer and hence leveling properties are reduced, which causes the deterioration of coat appearance. The method of adjusting the surface tension of the top coating material of the invention to the above-specified range includes, for example, a method of using various surface conditioners, and so on.

The method of forming the top coat layer includes methods using various conventionally-used coating means such as an air spray, an airless spray, a roll coater, a flow coater and the like. If needed, a substrate is heated before or after top coating, so that drying and/or curing can be accelerated.

The coating amount of the top coating material is preferably 20-200 g/m$^2$. When it is less than 20 g/m$^2$, hiding properties are inferior. While, when it exceeds 200 g/m$^2$, drying and/or curing tend to become worse and hence coat performance is reduced, such as crack generation, etc.

EXAMPLES

The examples will be shown below, but they are not intended as the limitations of the invention. Moreover, the "part(s)" in the examples means part(s) by mass.

Production Example 1

Preparation of Undercoating Material A 20 parts of titanium dioxide (product name: Tipaque CR-90 made by Ishihara Sangyo Kaisha, Ltd.), 10 parts of barium sulfate, 5 parts of a pigment dispersant (product name: BYK190 made by BYK Chemie Company) and 20 parts of water are mixed and then kneaded together in a bead mill for 5 hours to prepare a kneaded base material. 30 parts of the kneaded base material, 48 parts of a water-based dispersion of styrene/acrylic copolymer (product name: Acryset EX41 made by Nippon Shokubai Co., Ltd.), 18 parts of butyl cellosolve, 3 parts of a thickening agent (product name: Adekanol UH420 made by Adeka Corporation) and 1 part of an antifoamer (product name: SN Defoamer 1312 made by San Nopco Limited) are mixed under the condition of stirring to prepare an undercoating material A as a water-based enamel coating material. The coating material prepared is filtered to remove impurities.

Production Example 2

Preparation of Undercoating Material B 52 parts of a solvent-based acrylic resin (product name: Acrydic A-1381 made by DIC Corporation), 15 parts of titanium dioxide (product name: Tipaque CR-90 made by Ishihara Sangyo Kaisha, Ltd.), 8 parts of barium sulfate, 5 parts of a pigment dispersant (product name: BYK-111 made by BYK Chemie Company), 10 parts of butyl acetate and 10 parts of xylene are mixed and then kneaded together in a sand mill for 5 hours to prepare an undercoating material B as a solvent-based enamel coating material. The resulting coating material is filtered to remove impurities.

Production Example 3

Preparation of Active Energy Ray-Curing Type Inks 1-5

The detailed compositions of the active energy ray-curing type inks 1-5 are shown in Table 1. According to the formulation shown in Table 1, a raw material is mixed and stirred to homogenize it and thereafter it is kneaded in a bead mill for 5 hours to prepare active energy ray-curing type inks 1-5, respectively. The resulting ink composition is filtered to remove impurities.

TABLE 1

| | Ink-1 | Ink-2 | Ink-3 | Ink-4 | Ink-5 |
|---|---|---|---|---|---|
| Monarch 1000[1)] | 3.0 | | | 3.0 | 3.0 |
| Daipyroxide #3490E[2)] | | 3.0 | | | |
| FASTGEN Blue[3)] | | | 3.0 | | |
| Disper BYK 168[4)] | 1.5 | 1.5 | 1.5 | 1.5 | 1.5 |
| IBOA[5)] | 45.5 | 45.5 | 45.5 | | 45.5 |
| Light Acrylate PO-A[6)] | | | | 45.5 | |
| Light Acrylate 1.6HX-A[7)] | 22.0 | 22.0 | 22.0 | 22.0 | 19.5 |
| Urethane Acrylate AT-600[8)] | 20.0 | 20.0 | 20.0 | 20.0 | 20.0 |
| Tinuvin 1130[9)] | 0.5 | 0.5 | 0.5 | 0.5 | 0.5 |
| Irgacure 369[10)] | 7.0 | 7.0 | 7.0 | 7.0 | 7.0 |
| Polyflow KL-700[11)] | 0.5 | 0.5 | 0.5 | 0.5 | 3.0 |
| Total | 100.0 | 100.0 | 100.0 | 100.0 | 100.0 |

TABLE 1-continued

| | | Ink-1 | Ink-2 | Ink-3 | Ink-4 | Ink-5 |
|---|---|---|---|---|---|---|
| Viscosity (40° C.) | mPa · S | 25.00 | 25.10 | 25.30 | 25.00 | 24.00 |
| Mean particle diameter | nm | 95.0 | 88.0 | 98.0 | 95.4 | 95.4 |
| Surface tension (40° C.) | mN/cm | 26.0 | 25.0 | 27.8 | 31.0 | 18.5 |

1)Carbon black pigment made by Cabot Specialty Chemicals, Inc.
2)Cobalt blue pigment made by Dainichiseika Company
3)Copper phthalocyanine pigment made by DIC Corporation
4)Pigment dispersant made by BYK Chemie Company
5)Isobornyl acrylate made by Nippon Shokubai Co., Ltd.
6)Phenoxyethyl acrylate made by Kyoeisha Chemical Co., Ltd.
7)1,6-Hexanediol diacrylate made by Kyoeisha Chemical Co., Ltd.
8)Urethane acrylate prepolymer made by Kyoeisha Chemical Co., Ltd.
9)Ultraviolet light absorber made by BASF
10)Photo-polymerization initiator made by BASF
11)Surface conditioner made by Kyoeisha Chemical Co., Ltd.

Production Example 4

Preparation of Top Coating Material A 65 parts of a water-based dispersion of silicone-acrylic copolymer (product name: Poly Durex G620 made by Asahi Chemicals Co., Ltd.) is added with 20 parts of butyl cellosolve, 5.0 parts of a thickening agent (product name: Adekanol UH-420 made by Adeka Corporation) and 10 parts of a matting agent (product name: Sylysia 350 made by Fuji Silysia Chemical Ltd.) under the condition of stirring. The resulting coating material is filtered to remove impurities, preparing a top coating material A as a water-based clear coating material. The surface tension of the top coating material A is 40.5 mN/m.

Production Example 5

Preparation of Top Coating Material B 55 parts of an isocyanate-curing type acrylic resin (product name: Upicacoat AC3525 made by U-Pica Co., Ltd.) is added with 3 parts of a surface conditioner (product name: TEGO Glide 110 made by Evonik Industries), 10 parts of a matting agent (product name: Sylysia 350 made by Fuji Silysia Chemical Ltd.), 25 parts of butyl acetate and 5 parts of xylene under the condition of stirring to prepare a base material of a top coating material B as a solvent-based clear coating material. It is added with 2 parts of polyisocyanate (product name: Coronate HX made by Nippon Polyurethane Industry Co., Ltd.) as a curing agent immediately before coating. The surface tension of the top coating material B is 34.5 mN/m.

Production Example 6

Preparation of Top Coating Material C 30 parts of acryloyl morpholine (product name: ACMO made by Kohjin Co., Ltd.) is added with 20 parts of isobornyl acrylate (product name: IBOA made by Nippon Shokubai Co., Ltd.), 30 parts of aliphatic urethane acrylate oligomer (product name: CN983 made by Sartomer Company), 10 parts of a matting agent (product name: Sylysia 350 made by Fuji Silysia Chemical Ltd.), 2 parts of a surface conditioner (product name: BYK-377 made by BYK Chemie Company) and 8 parts of a photo-polymerization initiator (product name: Darocur 1173 made by BASF) under the condition of stirring to prepare a top coating material C as an active energy ray-curing type clear coating material. The surface tension of the top coating material C is 37.8 mN/m.

Examples 1-8

A slate plate of 15 mm in thickness is heated in a drying oven set at 80° C. until the surface temperature of the surface to be coated is 50° C. Then, the coating with various undercoating materials mentioned above is performed using an air spray, such that the coating amount is 100 g/m$^2$. Thereafter, it is left to stand for 5 minutes and then cured by drying in a drying oven set at 100° C. for 30 minutes, forming an undercoat layer.

The undercoat layer is coated with the active energy ray-curing type inks 1-5, respectively, prepared in Production Example 2 using an ink-jet printer (HEK-1 made by Konica Minolta, Inc.). Then, it is irradiated with UV light of 365 nm in wavelength using a metal halide lamp, such that the integrated amount of light is 300 mJ/cm$^2$.

The coated product, which is obtained by coating with the active energy ray-curing type ink and curing as mentioned above, is further coated with various top coating materials A-B, respectively, prepared in Product Examples 3-4 using an air spray, such that the coating amount is 100 g/m$^2$. Thereafter, it is left to stand for 5 minutes and then cured by drying in a drying oven set at 100° C. for 30 minutes, forming a top coat layer.

Example 9

The same process is carried out as in Example 1 except that the integrated light amount of active energy rays is 30 mJ/cm$^2$.

Example 10

The same process is carried out as in Example 1 except that the integrated light amount of active energy rays is 1000 mJ/cm$^2$.

Example 11

The coated product, which is obtained by coating with the active energy ray-curing type ink and curing in accordance with the same procedure as in Example 1, is further coated with the top coating material C prepared in Product Example 6 using an air spray, such that the coating amount is 50 g/m$^2$. Thereafter, it is irradiated with UV light of 365 nm in wavelength using a metal halide lamp, such that the integrated amount of light is 300 mJ/cm$^2$, forming a multilayer coat.

Comparative Example 1

The same process is carried out as in Example 1 except that the top coating step is not performed.

Comparative Example 2

The same process is carried out as in Example 1 except that the Ink-5 is used as the active energy ray-curing type ink.

<Ink Viscosity Measurement>

The viscosity of the active energy ray-curing type ink is measured using a rheometer (MCR301 made by Anton Paar Pysica Company) at a measurement temperature of 40° C. and a share rate of 10 $S^{-1}$.

<Particle Diameter Measurement>

The mean particle diameter of pigments in the active energy ray-curing type ink is measured using a dynamic light scattering measurement device (Nanotrac 150 made by Microtrac).

<Surface Tension Measurement>

The surface tension at 40° C. of the active energy ray-curing type ink and the surface tension at 25° C. of the top coating material are measured using a surface tensiometer (CBVP-Z made by Kyowa Interface Science Co., Ltd.).

<Measurement of Surface Free Energy of Undercoat>

In order to measure the surface free energy $\gamma_s$ of the undercoat, the following two substances, of which the surface free energy is known, are used: water (distilled water) ($\gamma_L/\gamma_L^d/\gamma_L^p$=72.8/29.1/43.7 mN/m); and liquid paraffin ($\gamma_L/\gamma_L^d/\gamma_L^p$=38.1/38.1/0 mN/m). The contact angle between the two substances and each test undercoat is measured and then the surface free energy of each test undercoat is calculated using the following equations.

$$\gamma_L(1+\cos\theta_L)=2(\gamma_s^d\times\gamma_L^d)^{1/2}+2(\gamma_s^p\times\gamma_L^p)^{1/2}$$

$$\gamma_s=\gamma_s^d+\gamma_s^p$$

<Measurement of Integrated Light Amount of Active Energy Rays>

The integrated light amount of UV light of 365 nm in wavelength is measured using an integral light counter for ultraviolet light (UIT-250 made by Ushio Inc.).

<Coated Product Appearance>

The appearance of the coated product which the multilayer coat is formed in is evaluated by visual observation.

[Evaluation Criteria]

A: There is no ink running or cissing, etc. Precise patterns are formed.

B: There is some ink running. But, patterns which have no practical problem are formed.

C: Ink running or cissing is observed. Precise patterns are not formed.

<Drying and Curing Properties of Ink>

The tackiness of the ink coat surface is evaluated by touch and cellophane tape peeling 60 seconds after the irradiation of active energy rays.

[Evaluation Criteria]

A: Tackiness is unfelt by touch. No attachment of an uncured ink to a tape is observed after peeling.

B: Tackiness is felt by touch. The attachment of an uncured ink to a tape is observable after peeling.

<Adhesive Properties>

It is evaluated according to JIS K-5600-5-6.

[Evaluation Criteria]

A: There is no change in coat appearance and the formed pattern, etc. There is no delamination.

B: There is a minor change in coat appearance or the formed patterns, etc. But, delamination is not observed and there is no practical problem.

C: There is a minor change in coat appearance or the formed patterns, etc. Delamination is slightly observed.

D: There is a severe change in coat appearance or the formed patterns, etc. Delamination is observed.

<Hot Water Resistance>

Each specimen is immersed in a water bath set at 50° C. for 10 days. The coat appearance after immersion is evaluated by visual evaluation and the adhesion test according to JIS-K-5600-5-6.

[Evaluation Criteria]

A: There is no change in coat appearance and the formed pattern, etc. There is no delamination.

B: There is a minor change in coat appearance or the formed patterns, etc. Delamination is slightly observed.

C: There is a severe change in coat appearance or the formed patterns, etc. Delamination is observed.

<Freezing and Thawing Damage Resistance Test>

The resistance to freezing and thawing damage of a test plate is evaluated according to Freezing and Thawing Damage Method B test (ASTM C666-B).

[Evaluation Criteria]

A: There is no abnormality.

B: Minor peeling and cracks are observed.

C: Marked peeling and cracks are observed.

<Evaluation of Weathering Resistance Test>

Concerning the building material having designability as obtained above, the weathering resistance is evaluated using a metal weather tester.

One cycle: L→R→Shower→D→Shower

L: Wavelength of 295-780 nm, light energy of 63 mW/$cm^2$ (temperature of 65° C., humidity of 70%), irradiation time of 16 hours R: No irradiation (temperature of 65° C., humidity of 70%), 2 hours Shower: Sprinkling of pure water for 10 seconds D: No irradiation (temperature of 30° C., humidity of 98% or more), 6 hours 20 cycles is carried out and then the weathering resistance is evaluated according to the following criteria. Gloss retention rate is calculated by a ratio of the specular gloss at 60° after weathering resistance test to the initial specular gloss at 60° of the surface of the building material having designability [gloss retention rate (%)=(gloss value after weathering resistance test/initial gloss value)×100], as measured by a digital variable angle gloss meter UGV-5D (made by Suga Test Instruments Co., Ltd.).

[Evaluation Criteria]

A: There is no change in coat appearance and the formed pattern, etc. Gloss retention rate is not less than 80%.

B: There is a minor change in coat appearance or the formed patterns, etc. But, gloss retention rate is not less than 80% and there is no practical problem.

C: There is a change in coat appearance and the formed pattern, etc. Gloss retention rate is not less than 65%.

D: There is a severe change in coat appearance or the formed patterns, etc. Gloss retention rate is less than 65%.

The results of the examples are shown in Table 2. The Examples 1-11 are excellent in coated product appearance, adhesive properties and weathering resistance. The undercoating material and the top coating material have comparable performance in any compositions. While, since the solvent-based coating material is used in the form of a two-part type curing system to achieve a sufficient coat performance, it needs premix before coating. Thus, the water-based coating material is preferably used in light of environmental consciousness, as mentioned above.

TABLE 2

| | | | Example 1 | Example 2 | Example 3 | Example 4 | Example 5 | Example 6 |
|---|---|---|---|---|---|---|---|---|
| Top coat layer | Top coating material | | A | A | A | A | A | B |
| Ink layer | Ink | | 1 | 2 | 1 | 3 | 4 | 1 |
| | Integrated amount of light | mJ/cm$^2$ | 300 | 300 | 300 | 300 | 300 | 300 |
| Undercoat layer | Undercoating material | | A | A | B | A | A | A |
| | $\gamma_s$ | mN/m | 40.5 | 40.8 | 32.5 | 40.8 | 40.6 | 40.5 |
| Appearance | | | A | A | A | A | A | A |
| Drying and curing properties of ink | | | A | A | A | A | A | A |
| Adhesive properties | | | A | A | A | A | B | A |
| Hot water resistance | | | A | A | A | A | A | A |
| Freezing and thawing damage resistance | | | A | A | A | A | A | A |
| Weathering resistance | | | A | A | A | B | B | A |

| | | | Example 7 | Example 8 | Example 9 | Example 10 | Example 11 |
|---|---|---|---|---|---|---|---|
| Top coat layer | Top coating material | | B | B | A | A | C |
| Ink layer | Ink | | 1 | 3 | 1 | 1 | 1 |
| | Integrated amount of light | mJ/cm$^2$ | 300 | 300 | 30 | 1000 | 300 |
| Undercoat layer | Undercoating material | | B | B | A | A | A |
| | $\gamma_s$ | mN/m | 31.8 | 30.8 | 41 | 40.8 | 41.2 |
| Appearance | | | A | A | A | A | A |
| Drying and curing properties of ink | | | A | A | A | A | A |
| Adhesive properties | | | A | B | B | B | B |
| Hot water resistance | | | A | A | A | A | A |
| Freezing and thawing damage resistance | | | A | A | A | A | A |
| Weathering resistance | | | A | B | B | B | B |

The results of the comparative examples are shown in Table 3. In the Comparative Example 1, the weathering properties are insufficient since a top clear coat is not formed on the layer of the active energy ray-curing type ink. In the Comparative Example 2, the surface tension of the active energy ray-curing type ink is too low, and hence the ink is wet-spread in large excess on the undercoat and the sharpness of the image is deteriorated.

TABLE 3

| | | | Comparative Example 1 | Comparative Example 2 |
|---|---|---|---|---|
| Top coat layer | Top coating material | | — | A |
| | Coating amount | g/m$^2$ | — | 100 |
| Ink layer | Ink | | 1 | 5 |
| | Integrated amount of light | mJ/cm$^2$ | 300 | 300 |
| Undercoat layer | Undercoating material | | A | A |
| | γs | mN/m | 40.5 | 40.8 |
| | Coating amount | g/m$^2$ | 100 | 100 |
| Appearance | | | A | B |
| Drying and curing properties of ink | | | A | A |
| Adhesive properties | | | C | C |
| Hot water resistance | | | C | C |
| Freezing and thawing damage resistance | | | C | C |
| Weathering resistance | | | D | D |

As can be seen from the results, the invention can achieve a multilayer coat having a high-definition image and being excellent in adhesive properties, quick-drying properties, hot water resistance, freezing and thawing damage resistance and weathering resistance.

The invention claimed is:

1. A method for producing a multilayer coat, comprising:

coating a substrate with an undercoating material to form an undercoat layer;

coating the undercoat layer with an active energy ray-curing ink in an ink-jet system, in which the active energy ray-curing ink comprises 50-90% by mass of at least one monomer having an ethylenic unsaturated group selected from the group consisting of phenoxyethyl (meth)acrylate, isobornyl (meth)acrylate, ethyl carbitol (meth)acrylate, cyclohexyl (meth)acrylate, neopentyl glycol di(meth)acrylate, 1,4-butanediol di(meth)acrylate, 1,6-hexanediol di(meth)acrylate and 1,9-nonanediol di(meth)acrylate, and 0.5-15% by mass of at least one inorganic pigment as a colorant;

curing the active energy ray-curing ink through active energy ray irradiation; and coating the cured active energy ray-curing ink with a top coating material to form a top coat layer;

wherein a surface free energy of the undercoat layer is $\gamma_s$=20-50 mN/m, the active energy ray-curing ink has a surface tension at 40° C. of 20-35 mN/m, and the top coating material has a surface tension at 25° C. of 20-50 mN/m.

2. The method for producing a multilayer coat according to claim 1, wherein the undercoat layer is formed by coating with a water-based coating material.

3. The method for producing a multilayer coat according to claim 1, wherein an integrated light amount of active energy rays which the active energy ray-curing ink is irradiated with is 50-500 mJ/cm$^2$.

4. The method for producing a multilayer coat according to claim 1, wherein the top coat layer is formed by coating with a water-based clear coating material.

5. The method for producing a multilayer coat according to claim 1, wherein the top coat layer is formed by coating with an active energy ray-curing clear coating material.

6. The method for producing a multilayer coat according to claim 2, wherein an integrated light amount of active energy rays which the active energy ray-curing ink is irradiated with is 50-500 mJ/cm$^2$.

7. The method for producing a multilayer coat according to claim 2, wherein the top coat layer is formed by coating with a water-based clear coating material.

8. The method for producing a multilayer coat according to claim 3, wherein the top coat layer is formed by coating with a water-based clear coating material.

9. The method for producing a multilayer coat according to claim 2, wherein the top coat layer is formed by coating with an active energy ray-curing clear coating material.

10. The method for producing a multilayer coat according to claim 3, wherein the top coat layer is formed by coating with an active energy ray-curing clear coating material.

11. The method for producing a multilayer coat according to claim 1, wherein the active energy ray-curing ink has a mean particle diameter of 40-500 nm and a cumulative maximum particle diameter is not more than 1 μm.

12. The method for producing a multilayer coat according to claim 1, wherein the active energy ray-curing ink has a viscosity of 5-15 mPa·s at 40° C.

* * * * *